US005493802A

United States Patent [19]

Simson

[11] Patent Number: 5,493,802

[45] Date of Patent: Feb. 27, 1996

[54] SCROLL DISPLAYING DEVICE

[76] Inventor: Anton K. Simson, 13227 Aubrey St., Poway, Calif. 92064

[21] Appl. No.: 195,394

[22] Filed: Feb. 14, 1994

Related U.S. Application Data

[63] Continuation-in-part of Ser. No. 67,738, May 26, 1993, Pat. No. 5,410,330.

[51] Int. Cl.[6] ..... G09F 11/18

[52] U.S. Cl. ..... 40/471; 40/518

[58] Field of Search ..... 40/471, 518, 364, 40/347, 385; 160/85, 120, 241, 310; 192/67 P

[56] References Cited

U.S. PATENT DOCUMENTS

| | | | |
|---|---|---|---|
| 2,677,967 | 5/1954 | Galbraith | 192/67 P X |
| 2,891,325 | 6/1959 | Breuning | 40/471 X |
| 3,479,985 | 11/1969 | Morley | 40/518 X |
| 3,510,973 | 5/1970 | Mazzocco, Sr. | 40/471 |
| 3,726,031 | 4/1973 | Singer | 40/471 |
| 3,829,997 | 8/1974 | Singer | 40/518 |
| 4,040,304 | 8/1977 | McCabe | 192/67 P X |
| 4,463,792 | 8/1984 | Lukos | 160/120 X |
| 4,862,614 | 9/1989 | Shettleroe | 40/518 X |

*Primary Examiner*—Joanne Silbermann

*Attorney, Agent, or Firm*—Henri J. A. Charmasson; John D. Buchaca

[57] ABSTRACT

A scroll displaying mechanism suitable for use in moving advertising displays, chart recorders and tape readers uses a pair of D.C. motors wired to operate under slightly different speed-controlling voltages in order to maintain the displayed part of the scroll between two rollers taut. A simple belt and pulley drive mechanism for each roller assures quiet and vibration-free operation. The viewing time between frame-advance and the scroll direction reversal are controlled by detection of different length markers positioned along one edge of the scroll. Also disclosed is a simple, easily assembled and disassembled display apparatus which allows both vertical and horizontal adjustment of the size of the viewing window frame.

17 Claims, 6 Drawing Sheets

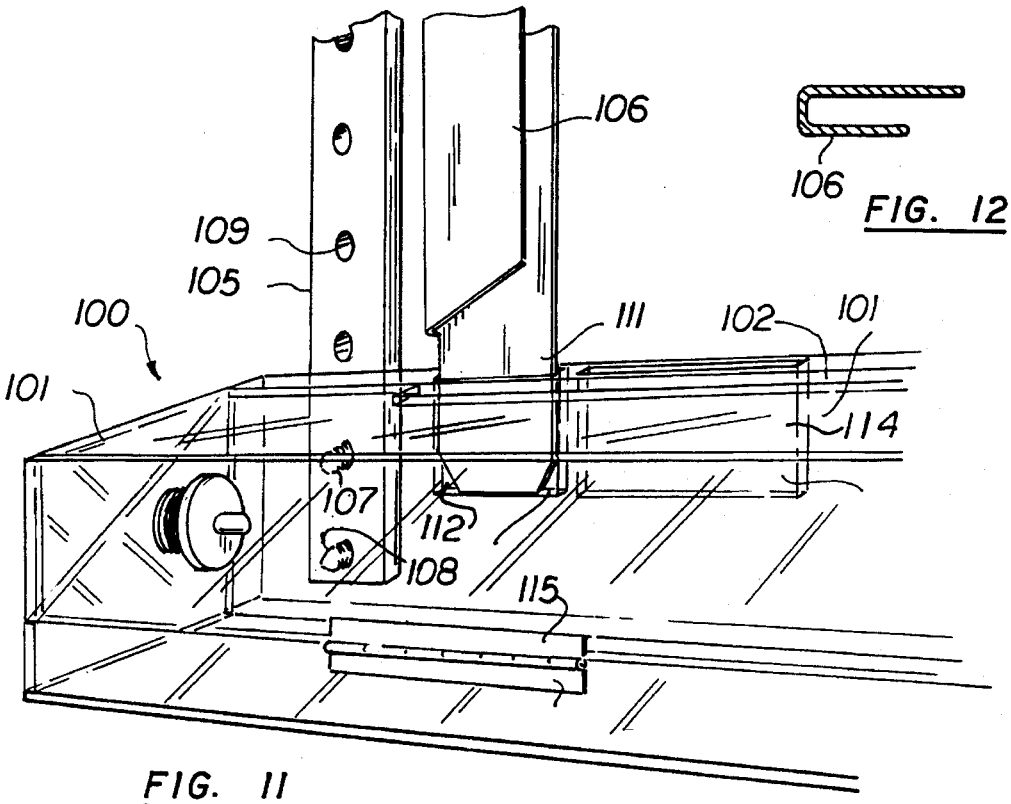
FIG. 12
FIG. 11
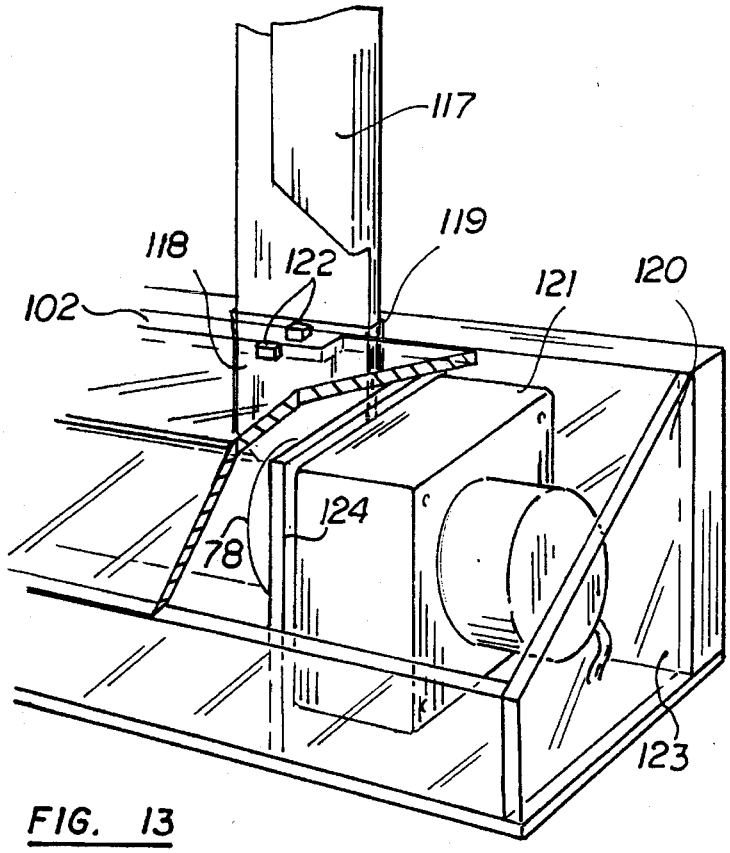
FIG. 13

19
150
146
151
154
19
148
155
147

160
161
177
180
162
176
181
159
153
165
178
166
163
171
162
176
164
182
175
ABC
174
179
ABC
157
156

161
152
180
149
181
DEF
20
150
DEF
175
174
GHI
166

170
152
169

176
159
181
177
182
173
171
166
168
154
167
172
158
157
20

SCROLL DISPLAYING DEVICE

PRIOR APPLICATION

This is a continuation-in-part application of application Ser. No. 08/067,738, filed May 26, 1993, now U.S. Pat. No. 5,410,330.

FIELD OF THE INVENTION

This invention relates to mechanisms for driving a display or recording medium scrolling between two rollers.

BACKGROUND OF THE INVENTION

Scrolling charts, banners or tapes that are alternately wound back and forth between a pair of rollers are commonly used on chart recorders, advertising displays and other devices where information must be continuously or intermittently displayed. In order to assure a smooth regular winding of the scrolling band and avoid creases and folds in the displayed section of the band between supply and take-up rollers, the band must be kept taut. This can be achieved by careful synchronization if the roller movements through precise guiding mechanisms, or by using tensioning idle rollers as disclosed in U.S. Pat. No. 3,726,031 Singer.

When separate motors are used to drive the rollers the speeds of the motors must be carefully matched. The scrolling system driving mechanism of the prior art are often complex, using driving gear assemblies which tend to be noisy and subject to vibration. The complexity of the prior art mechanism results in substantial cost of parts and assembly labor.

The present invention results from a search for a simple, yet precise and inexpensive scrolling chart mechanism that can be used on relatively small and portable devices particularly suitable for face-to-face teaching and sales presentation, window displays, as well as entertaining and decorative home photographic displays.

SUMMARY OF THE INVENTION

The principal and secondary objects of this invention are to provide a compact scrolling chart mechanism using a relatively small number of simple and inexpensive components, yet capable of providing a reliable and steady automatic display system that is quiet, vibration-free, reliable and easy to load and operate.

These and other objects are achieved by driving each roller with an inexpensive D.C. motor at slightly different speeds in order to maintain a steady tension of the scrolling chart, and by coupling the motors directly to the rollers or through sets of pulley and belt speed reducers using resilient 0-rings as belts in order to effectively dampen the drive mechanism and assure a smooth scrolling of the displayed material.

The motor and rollers are mounted in a plurality of easily assembled and disassembled, single-sided or double-sided, support structures which are adjustable to accommodate scrolls of different widths or to display longer sections of the scrolling band in a variety of settings.

BRIEF DESCRIPTION OF THE DRAWING

FIG. 11 is a perspective transparent view of one end of a housing of the apparatus of FIG. 6 having a spring loaded spindle;

FIG. 12 is a horizontal cross-sectional view of one of the scroll guides;

FIG. 13 is a perspective transparent view of one end of a housing of the apparatus of FIG. 6 having a keyed drive spindle;

DESCRIPTION OF THE PREFERRED EMBODIMENT OF THE INVENTION

Figures 1, 2, 3:
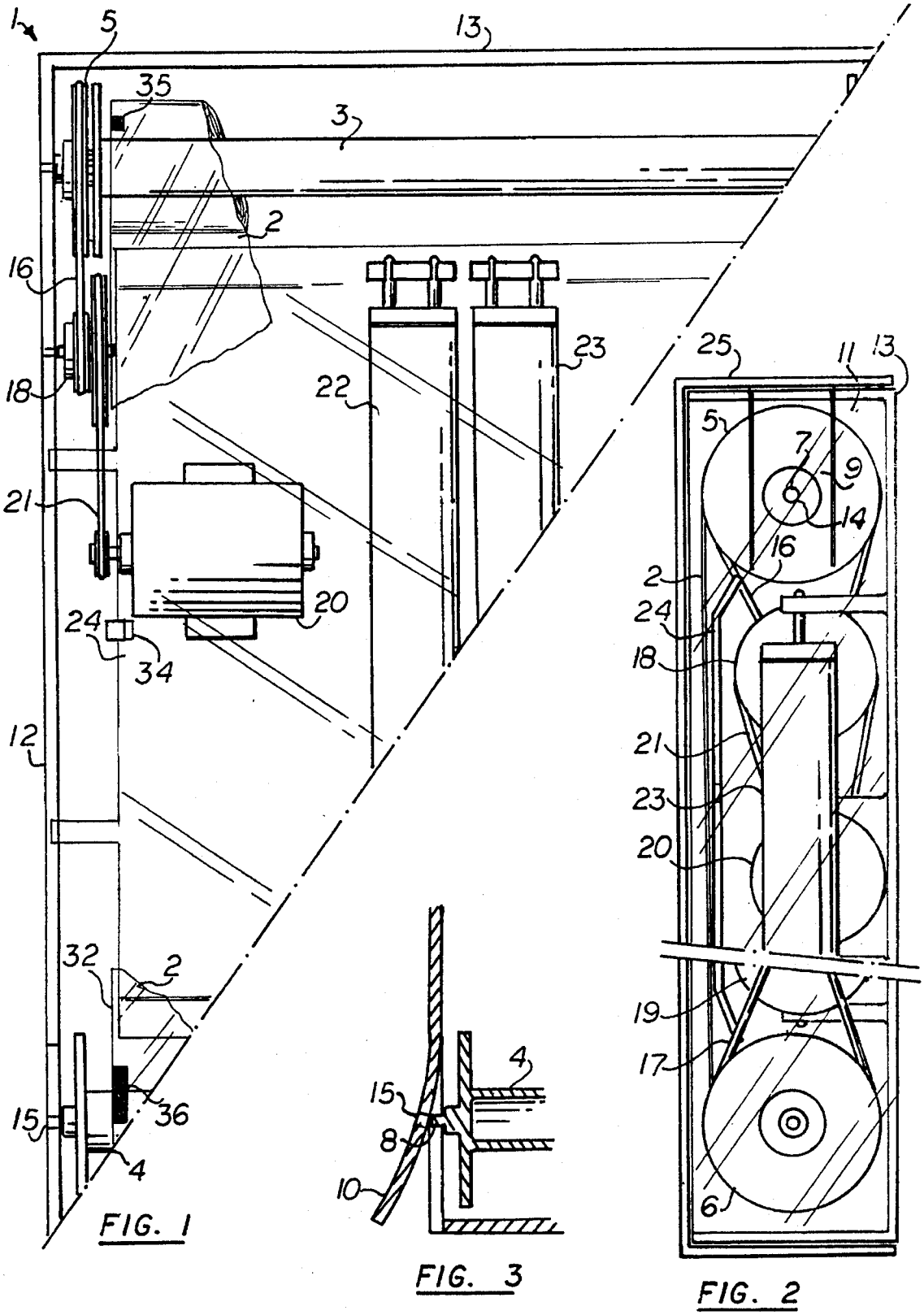
FIG. 1 is a one-half elevational front view of the uncovered scroll displaying apparatus; the missing half being a mirror image thereof.
FIG. 2 is a partial right side elevational view.
FIG. 3 is a detail cross-sectional view of the roll-locking/mechanism.

Referring now to the drawing, there is illustrated in FIGS. 1 and 2 a driving mechanism 1 for a scrolling chart 2 only partially and transparently illustrated, the opposite ends of which are wound around two parallel and spaced-apart rollers 3 and 4. Each roller 3, 4 has one end engaged into a driving pulley 5, 6. The other end has a spindle 7, 8 rotatively engaged into a section 9, 10 of a lateral wall 11, 12 of the housing frame 13. The roller-holding section 9, 10 is cut along three sides from the lateral wall 11, 12 so that it can be bent out, as illustrated in FIG. 3, to facilitate the engagement of the spindle 7, 8 into the bearing hole 14, 15 bored therethrough.

Each driving pulley 5, 6 is rotatively secured to one of the lateral walls 11, 12 and is coupled by means of a belt 16, 17 to a speed-reducing pulley assembly 18, 19 that is itself driven by a D.C. motor 20 by means of a belt 21. The belts 16, 17, 21 including the one not illustrated in the drawing and associated with the second motor driving the lower roller, are preferably inexpensive elastic O-rings that are resiliently stretched over the coupling pulleys. The use of this type of belt and pulley assembly provides a damping mechanism between the D.C. motor and the rollers. The mechanism is free of the noise and vibration inherent to spur-gear and worm-gear mechanisms used in the prior art. Moreover, the absence of such spur or worm-gear linkage allows for one of the motors and its associated coupling to be totally or partially dragged by the other motor through the scroll or chart 2. This last-described feature is particularly relied upon in this embodiment, as will be further explained, to maintain a certain tension of the scroll chart.

A pair of fluorescent tubes 22, 23 are mounted in the center of the housing frame 13 to provide backlighting of the scrolling chart 2. The tubes and part of the driving mechanism are covered by a translucent shroud 24 which doubles as a sliding surface for the scrolling chart.

As more specifically illustrated in FIG. 2, a cover 25 wrapping around the front face and sides of the frame 13 completes the housing assembly. Although the frame 13 and cover 25 have been illustrated as totally transparent in FIGS. 1–2 they should preferably be made of an opaque or translucent material except for the central viewing window portion 26 of the cover which should be kept transparent as illustrated in FIG.

In the preferred embodiment the apparatus is powered by a 12-volt D.C. current provided by a plug-in transformer and rectifier unit 27. The apparatus is operated by means of a control unit 28 which houses a series of switches and knobs, and is linked to the back of the frame 13 by way of a control cable 29.

One of the key features of the invention is the use of inexpensive D.C. motors of the type commonly found in toys which are run at slightly different speeds, but in the same direction in either the forward or reverse direction. The motor corresponding to the roller upon which the scrolling chart is being wound is powered by a slightly higher voltage than the other motor associated with the roller from which the chart is being taken. Accordingly, the second or dragging motor and associated pulley and roller are partially pulled through the intermediate area by the scrolling chart itself. This results in a slight tensioning of the chart which avoids creasing, folding and uneven scrolling. The different voltages applied to the motors and their resulting free speeds should be broad enough to accommodate the speed varying diameters of the rollers and resulting speed variations inherent to the system when one roller is being loaded while the other is being unloaded through the scrolling operation. Although the tensioning and regulating effect could be obtained by shutting off power to the second dragging motor, this approach would require the use of more powerful and therefore bigger and more expensive motors. By providing some power to the second motor and thus moving it in the same direction, the pulling force required from the first motor is considerably reduced.

Figure 5:
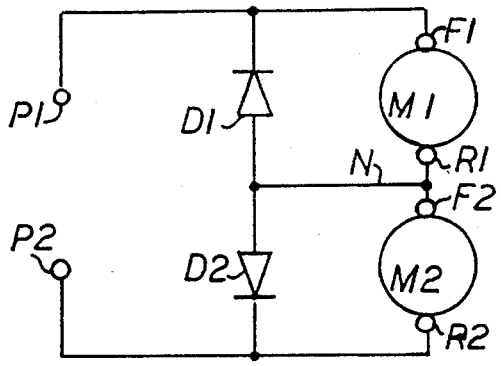
FIG. 5 is a simplified diagram of the motor-driving circuit.

FIG. 5 illustrates the power scheme used in supplying different voltages to the D.C. motors M1, M2 from a pair of power terminals P1, P2.

The motors run in a forward direction when a positive potential is applied on their respective forward winding terminals F1 and F2, and a reference or negative potential is applied to their reverse winding terminals R1 and R2. Such motors operate over a range of applied voltage and their speed increase with the applied voltage. The motors are wired in series between the power terminals P1, P2, and each motor winding is shunted by a diode D1, D2 or any other unidirectional current conducting device with the anodic poles of the diodes connected to the node point N between the two motors, and the cathodic poles of the diodes connected to the respective power terminals P1 and P2. When a positive forward-driving voltage is applied between the power terminals, the voltage across the second motor M2 is limited by the voltage drop inherent to the second diode D2 while the first motor M1 is subject to the difference between the voltage applied to the power terminals and the voltage drop across the second diode D2. Similarly, if the polarity of the voltage applied to the power terminals is inverted, the voltage applied to the first motor M1 is limited by the voltage drop across the first diode D1 while the second motor M2 will be subject to the same higher voltage that M1 was subject to during the forward-driving sequence. Moreover, it can be understood that by proper selection of the type and number of diodes or other types of unidirectional current-carrying devices used to shunt the respective motors, the relative speeds of the motors can be accurately set in both forward and reverse directions. The voltage drop across the shunting diode or diodes must be equal to or greater than the minimum operating voltage of the motor.

Figure 6:
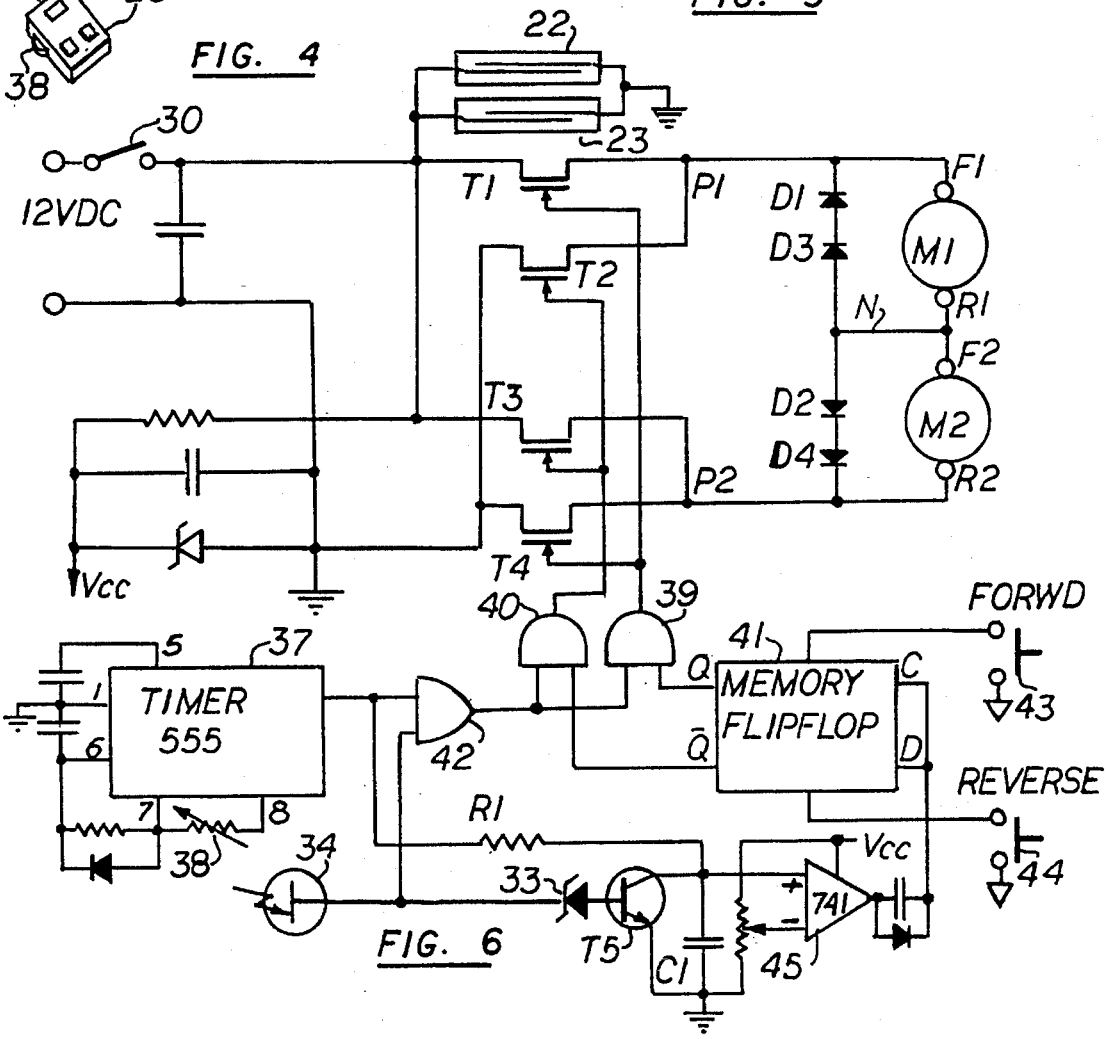
FIG. 6 is an electrical schematic of the apparatus.

The operation of the preferred embodiment of the apparatus will now be explained by reference to the schematic of FIG. 6. The D.C. motors M1 and M2 have a voltage range of 1 to 12 volts. Upon closure of the power switch 30 the 12-volt D.C. voltage from the transformer-rectifier unit 27 is applied to the circuitry. FET switches T1–T4 are used to alternately apply a positive 12-volt potential and ground reference to either power terminal P1 or P2. Diodes D1–D4 are used to apportion the voltages applied to motors M1 and M2. If we assume that each diode has a forward voltage drop of 1 volt, during forward drive operation, i.e., when the positive voltage is applied to terminal P1, 10 volts will be applied across the first motor M1 and 2 volts across the second motor M2. During a reverse scrolling operation, i.e., when transistors T2 and T3 are open and transistor T1 and T4 are closed, 10 volts will be applied to the second motor M2 and 2 volts only across motor M1. These driving voltages can be adjusted by adding or suppressing one or more of the diodes. It should be noted that it is not necessary that each motor be shunted with the same number of diodes. One may adjust the number of diodes to obtain a faster reverse speed than the forward speed by shunting the first motor M1 with a lesser number of diodes than motor M2. The forward or reverse operation is controlled by a memory flip-flop 31 which can be manually preset in either direction by activating either the forward switch 43 or the reverse switch 44 on the control unit 28. A photo sensor 34 is positioned to detect marks placed along one edge 32 of the chart or scroll 2. Two types of marks are used, a short mark or indicia 35 is used to locate the middle of each frame to be viewed except the first and last frame. A longer mark or indicator 36 is used to signal the middle of the first and last frame on the chart. As the chart advances the output signal of the photo sensor 34 conditioned by zener diode 33 and inverter T5 is analyzed in conjunction with the output signal of the timer 37 to either, cut the supply of the driving voltage fed to the motors by switching off all transistors T1–T4, or reverse the polarity of the driving voltage by enabling either the forward direction control transistors T1 and T4 or the reverse direction control transistors T2 and T3.

The two control gates 39, 40 are alternately enabled by the outputs of the memory flip-flop 41, and by the output of the timing gate 42. The memory flip-flop 41 can be manually preset to the forward or reverse mode by the control unit pushbutton switches 43 and 44. The flip-flop is also toggled by the output signals of an operational amplifier 45 wired as a voltage comparator.

The timer 37 is basically an a stable multivibrator which delivers a fixed, short move command and a viewing-time signal. The latter can be adjusted by means of potentiometeric switch 38 controlled by a thumb-wheel on the side of the control unit 28.

At the end of the frame-viewing period, as the output of the timer 37 goes high with the move command, the control gates are enabled through timing gate 42. The motors are then energized in the forward or reverse direction depending upon the status of the memory flip-flop 41. By the time the short move command expires and the timer output goes low, the frame indicia has moved from under the photo sensor 34, and its now high output keeps the control gates enabled through the timing gate 42. As the next mark on the chart reaches the photo sensor, the sensor output signal drops, cutting the power to the motors. The scrolling mechanism continues to move for a short time under its own momentum. If the sensed mark was a short frame-center indicia, it will be close to or already have moved past the sensor by the time the mechanism stops. The next move command will trigger a repetition of the just-described sequence. If, by contrast, the sensed mark is a long end-of-scroll indicator 36, part of the mark will remain under the photo sensor as the mechanism comes to a full stop. The move command pulse delayed by the R1/C1 circuit and biased by the high output of the inverter T5 is sensed by the operational amplifier 45 whose output toggles the memory flipflop, thus reversing the direction of the motors.

The structural, mechanical and electrical simplicity of this scroll-display device allows for the manufacture of reliable, yet inexpensive displays ranging in heights from approximately 15 cm (6 inches) to 75 cm (30 inches) suitable for displaying a variety of charts made of paper, fabric, mylar or other synthetic materials.

A scroll of fifty 2 cm×2 cm (8×10 inches) frames on a 25 microns (1 mil) thick printable plastic material results in a 3 cm (1.2 inch) diameter roll. The apparatus using this size of scroll requires a housing having overall dimensions of no more than 30×22.5×4.25 cm (12×9×1.7 inches).

An alternate embodiments of the apparatus can be powered by an internal set of batteries. In order to reduce the power requirement, the backlights 22, 23 can be eliminated. Instead, the back of the frame 13 is left transparent or translucent. The electrical control can be limited to a double-pole/double-throw rocker switch substituting for switches T1–T4, thus eliminating the timing and mark-detecting circuitry.

As the size of the display increases, the primary cost is associated with the frame and enclosure. To reduce this cost an alternate design is disclosed that is limited to the essential paper control elements in this second embodiment of the invention, illustrated in FIGS. 7–13 the mounting frame apparatus 70 is designed to be easily assembled, adjusted and collapsed. The frame comprises two housings or cartridges 71,72 for mounting the rollers 73,74 of the scroll 75. The cartridges are substantially mirror images of each other which allow passage of the scroll between them. Each cartridge provides means for rotatably mounting a roller to a rotational drive mechanism. In this embodiment, the means is provided by a spring loaded spindle 77 at one end of the cartridge and at the other end, a rotating keyed drive spindle 78 (obscured by the motor in FIG. 7) which mechanically couples the roller to a motor 79 when the roller is loaded into the cartridge.

Figure 8:
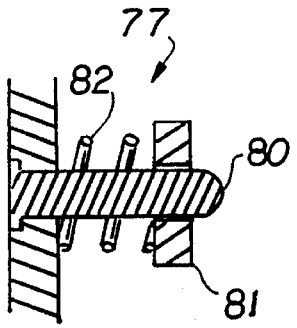
FIG. 8 is a cross sectional view of the spring loaded scroll mounting spindle of the apparatus of FIG. 7.
Figure 9:
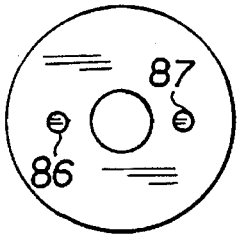
FIG. 9 is an end-on view of a roller showing holes for engaging either a spring loaded spindle or keyed drive spindle.
Figure 10:
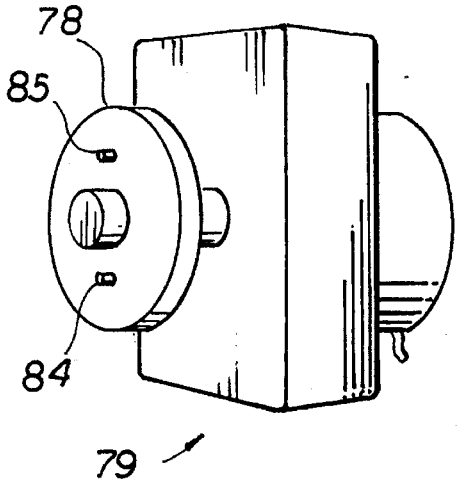
FIG. 10 is a simplified perspective view of a motor having a keyed drive spindle.

A detailed cross section of the spring loaded spindle 77 is seen in FIG. 8. It is of the type which is typical in the art having a central pin 80 which is dimensioned to rotatably engage a central hole in the end of a roller. A doughnut shaped pressure plate 81 is biased toward the end of an engaged roller by a spring 82. A close-up of the keyed drive spindle 78 is seen in FIG. 10 attached to the drive shaft of a motor 79. The drive spindle has off-rotational axis prominences 84, 85 which are sized and positioned to engage holes 86, 87 in an end of a roller seen in FIG. 9. The ends of the rollers may be made symmetrical so as to engage either type of spindle. It should be noted, however that there are an infinite number of ways to key the drive spindle. Spindles mounted within the cartridge should be the less expensive than spindles mounted on the rollers, however, any equivalent structure may be used. Also, this design requires no additional bearing for the roller beside the keyed spindle and the spring loaded spindle.

Referring again to FIG. 7, the cartridges are rigidly held in a parallel, spaced-apart orientation by two elongated support members 90, 91. In this case, the support members are shaped to act as guides to provide tracking for the scroll to keep the currently displayed portion of the scroll in a substantially planar orientation for viewing through the window area 92 formed between the guides 90, 91 and the cartridges 71,72. The guides restrict movement of the scroll directions outside the plane of the window, and also side to side movement thereby providing tight, stacked winding on the rollers.

In this embodiment, each cartridge has a removable cover 93 for protecting the scroll from dirt and damage. The upper cartridge 71 is shown with its cover removed, while the lower cartridge 72 shows its cover in the closed position. When the cover is in the closed position, there must remain an aperture 94 through the outer wall of the cartridge to allow passage of the scroll through to the window area 92. This aperture acts to guide the scroll between the roller and the guides. In addition the cover provides for simplicity in the roller mounting procedure by forcing the scroll into its correct position by merely closing the cover, obviating any need for more tedious threading. The cover also provides a contact point across the width of the scroll which further flattens the scroll for display and may be used to remove static which can build up on the scroll. By positioning an electrically conductive material along the length of the aperture to contact the scroll and connecting it to ground, the static charge on the scroll is removed. Alternatively, portions of the cartridge or the entire cartridge itself may be made of an electrically conductive material such as aluminum. It should be noted that if the cartridge is designed without a cover, a separate guide mechanism may be required to guide the scroll between the guides and the rollers.

FIG. 11 shows a cartridge 100 with its cover 101 in the closed position which still allows passage of the scroll through an oblong aperture 102 formed between an edge of the cover and an edge of the containment structure portion of the cartridge. Here, the cover is shown attached to the cartridge with at least one hinge 115. Also shown is a support member 105, separate from the guide 106. The support member is shown attached to the cartridge by screws 107, 108. The separation between the cartridges is made adjustable by providing a plurality of holes 109, spaced along the support members. Numerous other adjustable means for securing the members such as wingnuts engaging oblong holes, snaps, tongue/mortise style connectors or even VELCRO brand type fastening material may be used, as long as it is easily collapsible.

The guide 106 has a horizontal cross section which is generally U-shaped as seen in FIG. 12, and has an end prong 111 which is sized and dimensioned to releasably but securely engage a cavity 112 embedded in the cartridge. By providing additional cavities 114 in the cartridges, spaced apart from each other along the width dimension of the window area, scrolls of a different width can be accommodated by simply placing the guide in a different cavity. A plurality of cavities may be provided, or alternatively, a single variable cavity 114 may be made wider to allow fine adjustment in the lateral positioning of the guide.

It should be realized that the separate support members 105 are not needed if the guides are made strong enough and with sufficient tolerances to rigidly and detachably engage the cavities. FIG. 13 shows just such a guide 117 acting as a support member. The guide has an end prong 118 which is sized and dimensioned to releasably but securely engage a cavity 119 embedded in the cartridge 120. In addition to showing the motor 121, the figure shows a sensor 122 positioned to detect the passage of indicator marks on the edge of a scroll as described earlier.

Figure 7:
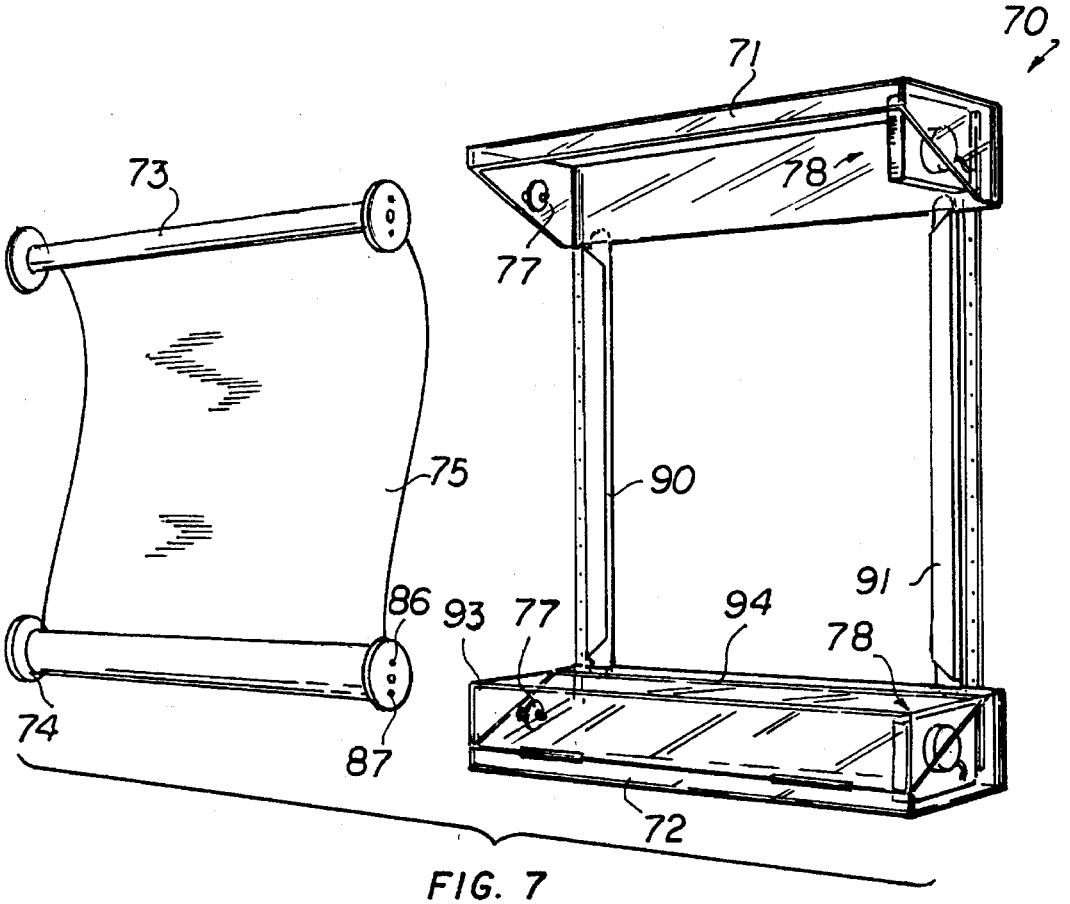
FIG. 7 is a perspective view of an easily assembled second embodiment of the invention.

The uniform cross-section of the cartridges make them ideally suited to be formed out of bent sheet metal with simple end plates installed at both ends. Alternately, the cartridges could be made of plastic, however any strong rigid material will suffice. FIG. 7, 11 and 13 show the cartridges being transparent for purposes of illustration; but this is not critical. In its simplest configuration, each cartridge may consist essentially of the back plate 123 and of a pair of brackets 124 positioned at opposite ends to mount the motor and spindle assemblies.

This invention is particularly adapted for use in connection with glass-faced display enclosures, windows and other framing structures that can provide a lateral, back, or upper and lower support for the roller assemblies.

Figure 14:
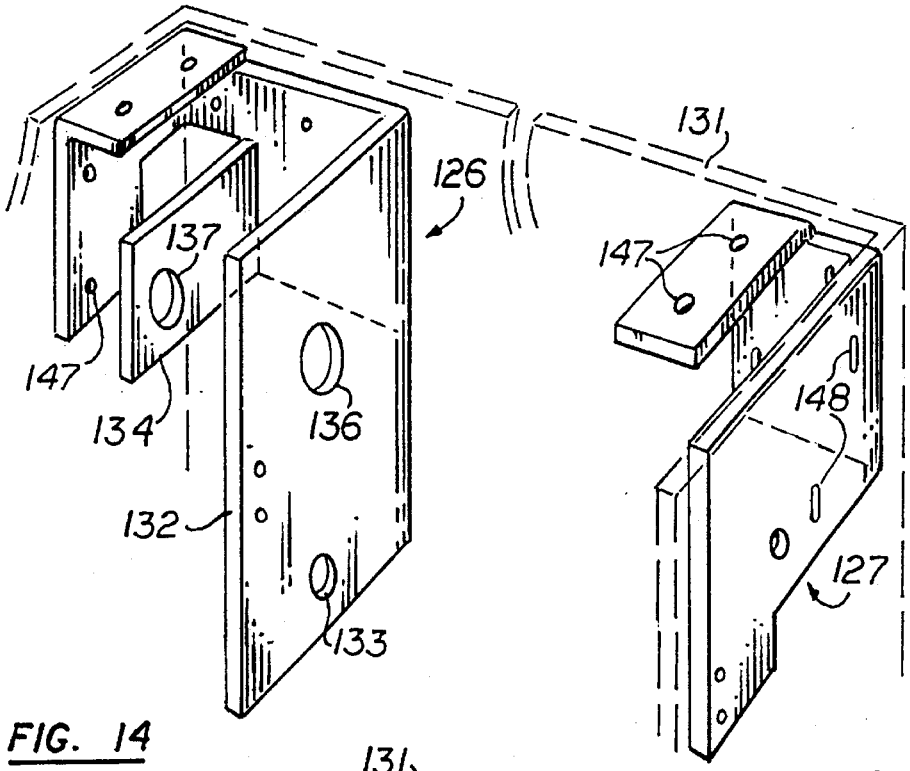
FIG. 14 is a perspective view of left and right hand roller support brackets used in a third embodiment of the invention.
Figure 15:
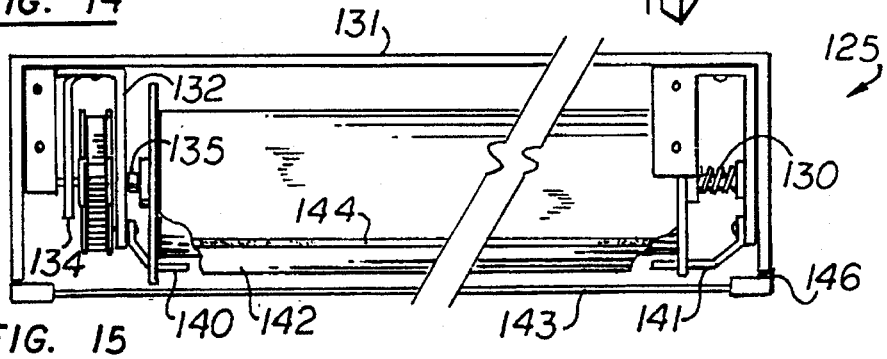
FIG. 15 is a top plan view of the roller assembly.
Figure 16:
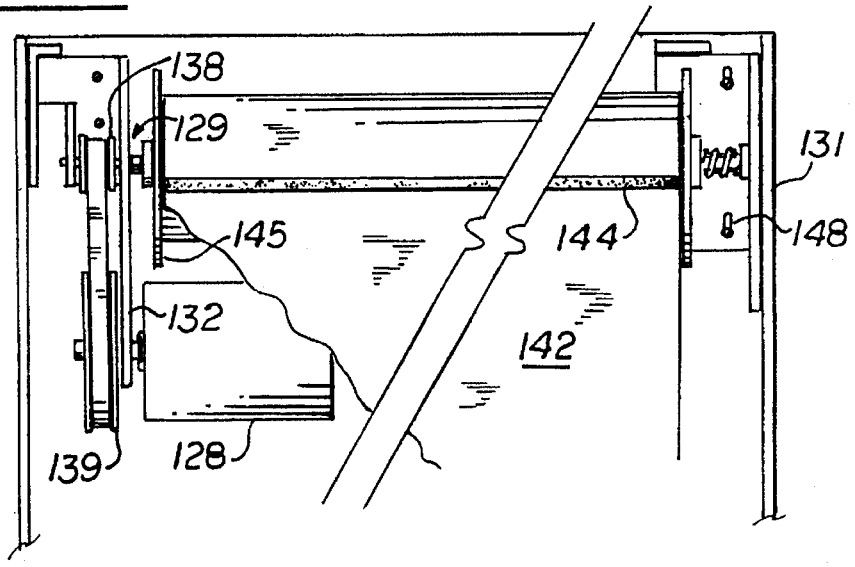
FIG. 16 is a partial front elevational view thereof.
Figures 17, 18, 19, 20, 21:
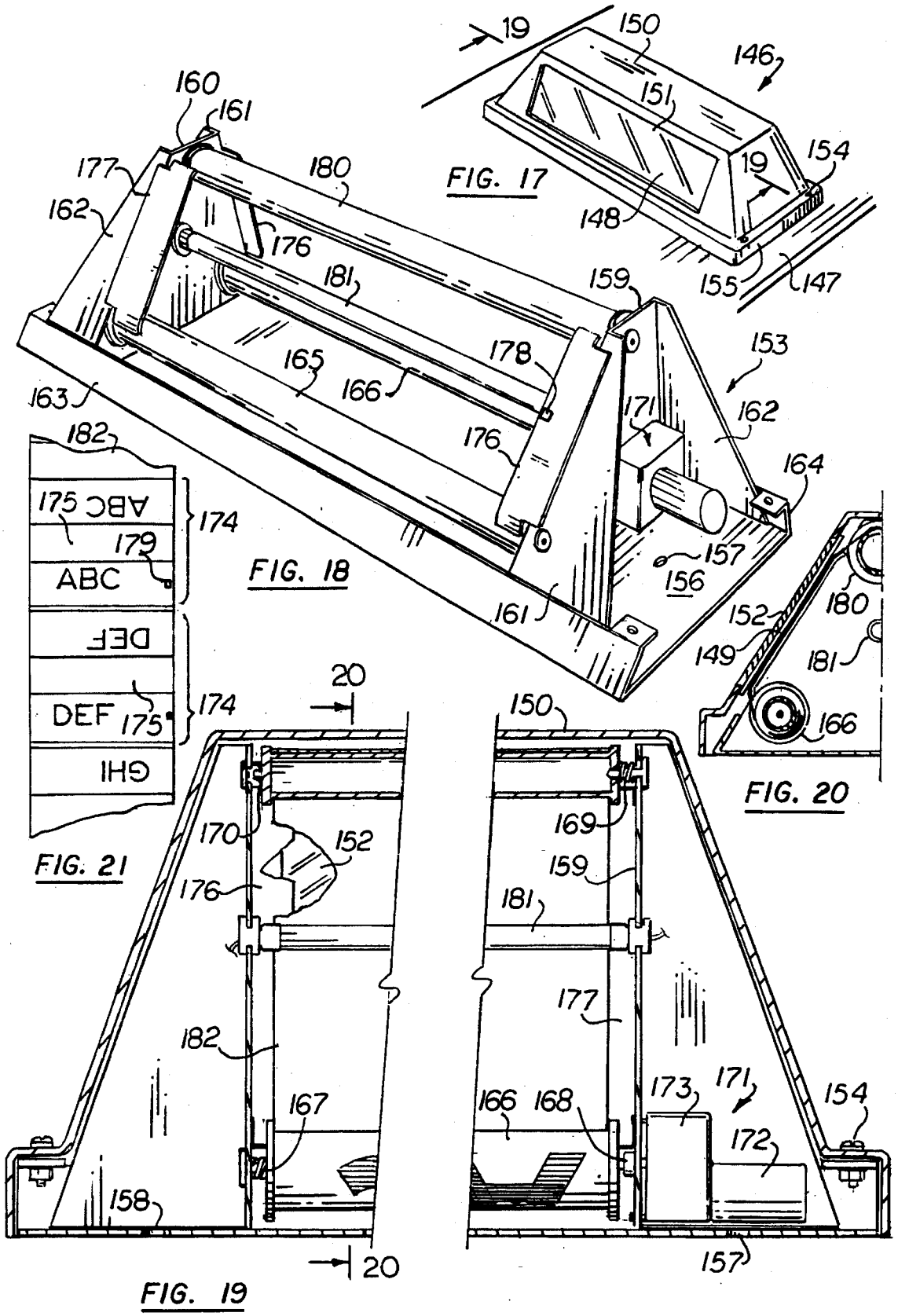
FIG. 17 is perspective view of a double-sided, fourth embodiment of the invention.
FIG. 18 is a perspective view thereof with the cover and scroll removed.
FIG. 19 is a cross-sectional view taken along line 19—19 of FIG. 17.
FIG. 20 is a half-cross-sectional view taken along line 20—20 of FIG. 18.
FIG. 21 is a top plan view of a section of a banner scroll.

In the third embodiment of the invention illustrated in FIGS. 14–16, a left-hand bracket 126 is used to support the motor 128 and roller drive mechanism 129, and a right-hand bracket 127 is used to support the spring-biased roller spindle assembly 130. Each bracket has a right-angled outline for mounting against any vertical backplane and/or lateral support structure 131, or any horizontal surface. In FIG. 14, the support structure is shown transparent and in phantom line for the sake of clarity. Such a structure could be provided by the frame of a pre-existing stationary display or the face of a billboard. For the purpose of this disclosure, the third embodiment will be further described in connection with a shallow display cabinet 131 having a transparent front door 143 with right-hand hinges 146.

All faces of the brackets have a plurality of mounting holes 147. The right-hand bracket 127 has vertically elongated holes 148 to facilitate height adjustment. Although only the upper roller support assembly is illustrated in the drawing, it will be easily understood that the support brackets for the lower assembly needs only be an exact mirror image of the one illustrated.

The left-hand bracket 126 has an inner support flange 132 with at least one bore 133 in a lower section. The bore is sized and dimensioned to mount the motor 128 and its pulley 138. An outer support flange 134 is held parallel to the inner flange. The axle 135 of the roller drive mechanism 129 passes through bearings held within bores 136 and 137 in an upper section of the inner and outer support flanges respectively. The roller drive pulley 138 is sandwiched between the two support flanges, and lined up with the motor pulley 139 mounted on the opposite side of the inner flange from the motor 128.

A pair of simple banner scroll side guides 140, 141 may be used in lieu of the translucent plate 24 of the first embodiment and in lieu of the U-shaped guides 106 of the second embodiment. However this embodiment of the scroll display device can be satisfactorily implemented without using any of the support members 105 of the second embodiment or even any side guides, so long as the brackets 126, 127 can be attached to a supporting structure. The side guides 106 span the space between the upper and lower rollers and are positioned so that their tips come into sliding contact with the back, left-hand marginal portion of the banner scroll 142. The side guides have been omitted in FIG. 16 for the sake of clarity. Thus, the edges of the banner scrolls slide between the side guides and the transparent door 143 of the supporting structure. In order to prevent clinging of the banner scroll and discharge any friction-generated static that may have built up in the banner scroll, guides 140 and 141 are preferably made of conductive material and grounded. A strip of electrically conductive material 144 is placed between two banners within the scroll. The ends of the strip are folded back against the marginal portions of the banner scroll which comes in contact with the guides.

An optical detector is mounted preferably on the left-hand guide half way between the two rollers, and positioned to detect the passage of marks placed along the corresponding edge of each banner frame. As previously described in connection with the first embodiment, detection of the marks is used to properly position each frame for display.

The spacing between the two rollers is preferably slightly larger on the side opposite the optical detector in order to urge the banner scroll against the opposite roller end plate 145, thus assuring proper alignment of the marks with the detector.

It should be noted that for ease of installation and access to the roller drive mechanism, the spring-biased spindles are located on the hinged side of the door 143.

The two-sided fourth embodiment 146 of the scroll displaying device illustrated in FIGS. 17–21 is designed to be mounted on a planar, horizontal surface 147 such as the roof of a taxi cab or other utility vehicle. It is characterized by two display windows 148, 149 in parallel and opposite sides of the display. The device comprises a molded enclosure 150 with transparent panels 151, 152 sealing the windows. The enclosure 150 is secured to an underlying armature 153 by four screws 154 driven through the corner of a flange 155 around the base of the enclosure.

The armature 153 comprises a rectangular bottom tray 156 securable to the mounting surface 147 through a pair of holes 157, 158, or other equivalent attachment means. Two parallel, vertical, and spaced-apart support plates 159, 160 are mounted into the tray 156 to support the scroll rollers and drive mechanism.

Each support plate is strengthened by a pair of lateral gussets 161, 162 which are welded or bolted at their base to the sides 163, 164 of the tray. The tray and support plate can conveniently be made from folded pieces of sheet metal. Each of a pair of scroll rollers 165, 166 is mounted between two lower corners of the support plates. An idler roller 80 is mounted in a substantially parallel position in relation to the scroll rollers between the apex sections of the support plates.

It should be understood that while in the triangular arrangement of the rollers, the scroll rollers 165, 166 are spaced apart to place the displayed sections of the scroll into convergent planes, other embodiments of the two-faced displaying device the two scroll rollers could be brought closer together and the diameter of the idler roller 80 increased to place the displayed sections of the scroll into parallel planes.

As in the previously-described embodiments, the scroll rollers are rotatively mounted in a detachable manner between a spring-biased idling spindle 167 and a driving spindle 168. The idler roller 80 is similarly mounted between a spring-biased idling spindle 169 and a stationary idling spindle 170 for easy removal and installation of the scroll. Each driving spindle is connected to a roller drive assembly 171 which comprises an electrical DC motor 172 and a speed-reducing gear mechanism 173 hidden on the drawing by its enclosure.

Assuming that the same message is to be displayed through the opposite windows 148, 149, the scroll is divided into pairs 174 of identical, but inverted banners separated by a blank space 175 corresponding to the amount of scroll material necessary to bridge the distance between the tops of the opposite windows over the idler roller 80. A pair of scroll-guides 176, 177 are welded to the triangular gussets 161, 162 and are dimensioned to extend under marginal, opposite sections of the scroll. A banner mark detector 178 need only to be mounted on a median section of one of the guides, and a corresponding mark 179 placed along the edge of one of each pair of banners 174. Backlighting of the part of the scroll-banner 182 being displayed is provided by a fluorescent tube 181 installed in the center of the armature.

While the preferred embodiments of the invention have been described, modifications can be made and other embodiments may be devised without departing from the spirit of the invention and the scope of the appended claims.

What is claimed is:

1. A display apparatus which comprises:

a scroll having a ring end and a trailing end;

a first roller having said leading end wound thereupon;

a second roller having said trailing end wound thereupon;

resiliently detachable means for rotatively mounting said first and second rollers;

means for holding said first and second rollers in a substantially parallel and adjustably spaced-apart position in relation to each other;

a first motor and means for driving said first roller with said first motor;

a second motor and means for driving said second roller with said means for mounting comprise:

first and second cartridges each dimensioned to receive one of said rollers therein;

said means for holding comprises:

a pair of elongated support members; and adjustable means for securing said cartridges to various locations along a length of said support members, thereby maintaining said cartridges in a substantially parallel spaced apart position; and wherein each of said cartridges comprises:

means for rotatably mounting one of said rollers and one of said motors within said cartridge; and means for coupling said one of said motors to said one of said rollers.

2. The apparatus of claim 1, wherein said means for holding further comprises:

a pair of scroll guides sized, dimensioned and positioned to provide tracking for said scroll as it travels between said first and second cartridge; and, adjustable means for securing said scroll guides to said cartridges.

3. The apparatus of claim 2, wherein said support members and said scroll guides are substantially perpendicular to both of said cartridges.

4. The apparatus of claim 1, wherein said means for rotatably mounting one of said rollers within said cartridge comprises:

at least one spring loaded spindle dimensioned to releasably engage an end of said roller.

5. The apparatus of claim 4, wherein said means for coupling said motor to one of said rollers comprise a keyed spindle which transmits the torque generated by one of said motors to the rotational axis of one of said rollers.

6. The apparatus of claim 1, wherein each of said cartridges further comprises:

a containment structure portion;

a cover sized and dimensioned so that while said cover is in a closed position, there remains an oblong aperture formed between an edge of said cover and an edge said containment structure portion; and said oblong aperture dimensioned to allow passage of said scroll through said aperture as it travels between each of said rollers in a substantially flat configuration.

7. The apparatus of claim 1, wherein said means for holding further comprises:

a scroll guide integral with each support member, said guide being sized, dimensioned and positioned to provide tracking for said scroll as it travels between said first and second cartridge.

8. A display apparatus which comprises:

a scroll having a leading end and a trailing end;

a first roller having said leading end wound thereupon;

a second roller having said trailing end wound thereupon;

resiliently detachable means for rotatively mounting said first and second rollers;

means for holding said first and second rollers in a substantially parallel and adjustably spaced-apart position in relation to each other;

a first motor and means for driving said first roller with said first motor;

a second motor and means for driving said second roller with said second motor; and wherein said means for mounting comprise:

first and second cartridges each dimensioned to receive one of said rollers therein;

wherein said means for holding comprises:

a pair of elongated support members; and adjustable means for securing said support members to said cartridges, thereby maintaining said cartridges in a substantially parallel spaced apart position;

wherein each of said cartridges comprises:

means for rotatably mounting one of said rollers and one of said motors within said cartridge; and means for coupling said one of said motors to said one of said rollers;

wherein said means for holding further comprises:

a pair of scroll guides sized, dimensioned and positioned to provide tracking for said scroll as it travels between said first and second cartridge; and, adjustable means for securing said scroll guides to said cartridges;

wherein said support members and said scroll guides are substantially perpendicular to both of said cartridges; and wherein said adjustable means for securing said scroll guides to said cartridges comprise:

a plurality of cavities embedded in each of said cartridges; and, each of said scroll guides having two ends, each end terminating in a prong sized and dimensioned to engage one of said cavities.

9. The apparatus of claim 8, wherein said scroll guides are integral with said support members and said adjustable means for securing said scroll guides provides said adjustable means for securing said support members.

10. The apparatus of claim 8, wherein at least one of said cavities is a variable cavity dimensioned wider than said prong to allow variable lateral positioning of said prong within said variable cavity.

11. A display apparatus which comprises:

a scroll having a leading end and a trailing end;

a first roller having said leading end wound thereupon;

a second roller having said trailing end wound thereupon;

resiliently detachable means for rotatively mounting said first and second rollers;

means for holding said first and second rollers in a substantially parallel and adjustably spaced-apart position in relation to each other;

a first motor and means for driving said first roller with said first motor;

a second motor and means for driving said second roller with said second motor;

means for controlling movements of said scroll between said first and second rollers;

said means for controlling comprise:

a plurality of spaced-apart frame indicia located along said scroll, and at least one scroll-end indicator located proximately to one of said ends;

means for detecting said indicia and said end indicator; and means responsive to said means for detecting, for temporarily disconnecting a first drive voltage from said first motor and a second drive voltage from said second motor upon detection of one of said indicia and for reversing the polarity of said drive voltages upon detection of said end indicator.

12. The apparatus of claim 11, wherein each of said indicia comprises a first mark of a given longitudinal length along one edge of said scroll;

said indicator comprises a second mark having a different longitudinal length than said first mark; and said means for detecting comprise means for differentiating between said first and said second marks.

13. The apparatus of claim 11, wherein:

said means for mounting comprises:

first and second cartridges each dimensioned to receive one of said rollers therein;

said means for holding comprises:

a pair of elongated support members; and adjustable means for securing said support members to said cartridges, thereby maintaining said cartridges in a substantially parallel spaced apart position; and wherein each of said cartridges comprises:

means for rotatably mounting one of said rollers and one of said motors within said cartridge; and means for coupling said one of said motors to said one of said rollers.

14. The apparatus of claim 13, wherein said means for holding further comprises:

a pair of scroll guides sized, dimensioned and positioned to provide tracking for said scroll as it travels between said first and second cartridge; and, adjustable means for securing said scroll guides to said cartridges.

15. The apparatus of claim 13, wherein said means for rotatably mounting one of said rollers within said cartridge comprises:

at least one spring loaded spindle dimensioned to releasably engage an end of said roller.

16. The apparatus of claim 13, wherein each of said cartridges further comprises:

a containment structure portion;

a cover sized and dimensioned so that while said cover is in a closed position, there remains an oblong aperture formed between an edge of said cover and an edge said containment structure portion; and said oblong aperture dimensioned to allow passage of said scroll through said aperture as it travels between each of said rollers in a substantially flat configuration.

17. The apparatus of claim 11, wherein said means for holding further comprises:

a scroll guide integral with each support member, said guide being sized, dimensioned and positioned to provide tracking for said scroll as it travels between said first and second cartridge.

* * * * *

UNITED STATES PATENT OFFICE

CERTIFICATE OF CORRECTION

PATENT NO. : 5,493,802

DATED : February 27, 1996

INVENTOR(S) : ANTON K. SIMSON

It is certified that error appears in the above-identified patent and that said Letters Patent is hereby corrected as shown below:

In column 1, line 54, replace "O-rings" with --O-rings--.

Figure 4:
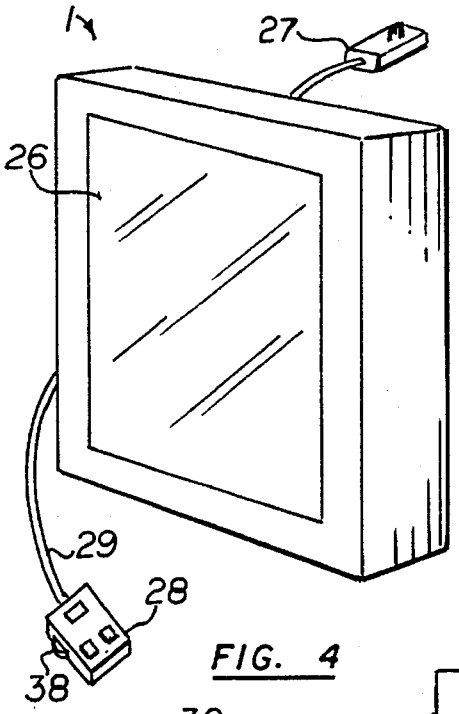
FIG. 4 is a perspective view of the apparatus.

In column 3, line 21, replace "FIG" with --FIG. 4--.

In column 4, line 66, replace "a stable" with --astable--.

In column 9, line 30, replace "ring" with --leading--.

In column 9, line 42, replace "with" with --with said second motor;—.

Signed and Sealed this

Fourth Day of June, 1996

Bruce Lehman

*Attest:*

BRUCE LEHMAN

*Attesting Officer*

*Commissioner of Patents and Trademarks*